US010718303B2

(12) United States Patent
Oh et al.

(10) Patent No.: US 10,718,303 B2
(45) Date of Patent: Jul. 21, 2020

(54) INJECTOR FIXING STRUCTURE OF FUEL RAIL

(71) Applicant: HYUNDAI KEFICO CORPORATION, Gunpo, Gyeonggi-do (KR)

(72) Inventors: Seung-Hyuk Oh, Gyeonggi-do (KR); Young-Il Kang, Gyeonggi-do (KR); Kwang-Won Koo, Seoul (KR); Yeon-Jee Oh, Seoul (KR)

(73) Assignee: HYUNDAI KEFICO CORPORATION, Gunpo, Gyeonggi-do (KR)

( * ) Notice: Subject to any disclaimer, the term of this patent is extended or adjusted under 35 U.S.C. 154(b) by 0 days.

(21) Appl. No.: 16/018,587

(22) Filed: Jun. 26, 2018

(65) Prior Publication Data

US 2018/0372046 A1 Dec. 27, 2018

(30) Foreign Application Priority Data

Jun. 27, 2017 (KR) ..... 10-2017-0081249

(51) Int. Cl.
*F02M 61/14* (2006.01)
*F02M 61/16* (2006.01)

(52) U.S. Cl.
CPC ..... *F02M 61/14* (2013.01); *F02M 61/168* (2013.01); *F02M 2200/853* (2013.01); *F02M 2200/856* (2013.01)

(58) Field of Classification Search
CPC ..... F02M 61/14; F02M 61/16; F02M 61/168; F02M 2200/853; F02M 2200/856
(Continued)

(56) References Cited

U.S. PATENT DOCUMENTS 2,752,679 A * 7/1956 Shenkin ..... B26B 5/006 30/336
5,520,151 A * 5/1996 Gras ..... F02M 41/14 123/469

(Continued)

FOREIGN PATENT DOCUMENTS

JP 11-22589 * 1/1999
JP 2007-224914 A 9/2007

(Continued)

OTHER PUBLICATIONS

JP 11-22589 English Translation Verson.*

*Primary Examiner* — John Kwon
*Assistant Examiner* — Johnny H Hoang
(74) *Attorney, Agent, or Firm* — Mintz Levin Cohn Ferris Glovsky and Popeo, P.C.; Peter F. Corless

(57) ABSTRACT

Disclosed herein is an injector fixing structure of a fuel rail. The injector fixing structure for a fuel rail module is configured such that an injector cup that includes a slot formed at a side thereof and an injector that includes an anti-rotation pin inserted into the slot are coupled to each other by a clip. The injector fixing structure also includes a lock formed integrally with the anti-rotation pin, and a fixing member coupled to the slot and allowing the lock to be secured when the anti-rotation pin is inserted into the slot such that the anti-rotation pin is prevented from being separated from the slot. The present invention may prevent separation of the injector from the fuel rail during transportation of the fuel rail module, thereby improving assemblability of the fuel rail module in engine assembly and increasing process efficiency.

4 Claims, 6 Drawing Sheets

(58) Field of Classification Search
USPC ..... 123/445, 456, 470–472
See application file for complete search history.

(56) References Cited

U.S. PATENT DOCUMENTS

| | | | | | |
|---|---|---|---|---|---|
| 5,598,824 | A * | 2/1997 | Treusch | F02M 51/005 | 123/456 |
| 5,803,052 | A * | 9/1998 | Lorraine | F02M 61/145 | 123/456 |
| 6,457,456 | B1 * | 10/2002 | Scollard | F02M 61/145 | 123/470 |
| 7,802,559 | B2 * | 9/2010 | Furst | F02M 61/14 | 123/470 |
| 2002/0100456 | A1 * | 8/2002 | Panasuk | F02M 55/004 | 123/456 |
| 2006/0065244 | A1 * | 3/2006 | Norcutt | F02M 55/02 | 123/470 |
| 2010/0300406 | A1 * | 12/2010 | Harvey | F02M 55/025 | 123/456 |
| 2015/0128908 | A1 * | 5/2015 | Matteini | F02M 61/14 | 123/470 |
| 2016/0020440 | A1 * | 1/2016 | Kesper | H01M 2/06 | 429/158 |

FOREIGN PATENT DOCUMENTS

| | | | |
|---|---|---|---|
| KR | 10-2016-0023898 | A | 3/2016 |
| KR | 10-1739694 | B1 | 5/2017 |

* cited by examiner (Related Art)

INJECTOR FIXING STRUCTURE OF FUEL RAIL

CROSS REFERENCE TO RELATED APPLICATION

This application claims the benefit of Korean Patent Application No. 10-2017-0081249, filed Jun. 27, 2017, which is hereby incorporated by reference in its entirety into this application.

TECHNICAL FIELD

The present invention relates generally to an injector fixing structure of a fuel rail and, more particularly, to an injector fixing structure of a fuel rail which prevents an injector from being separated from the fuel rail.

RELATED ART

As well known to those skilled in the art, fuel rails and injectors are assembled into modules to form engine components, thereby reducing costs in engine assembly and increasing efficiency. FIG. 1 shows an injector fixing structure of a fuel rail of a fuel rail module according to the related art. Referring to FIG. 1, the injector fixing structure is configured such that an injector 1 is coupled to an injector cup 2 of a fuel rail by a clip 3, and upon engagement thereof, an anti-rotation pin 10 provided at the injector 1 is inserted into a slot 20 provided at the injector cup 2 to prevent rotation of the injector 1 during operation.

However, the injector fixing structure of the fuel rail of the fuel rail module according to the related art is problematic in that because there is provided no fixing feature for preventing the injector 1 from being separated in a direction indicated by the arrow A in FIG. 1, there is often a case where the injector 1 is separated from the injector cup 2 during transportation of the fuel rail module and is needed to be coupled thereto again upon engine assembly. This process requires time and may result in increased assembly costs and in decreased process efficiency.

The above information disclosed in this section is merely for enhancement of understanding of the background of the invention and therefore it may contain information that does not form the prior art that is already known in this country to a person of ordinary skill in the art.

SUMMARY

An object of the present invention is to provide an injector fixing structure of a fuel rail, the injector fixing structure capable of preventing an injector from being separated from the fuel rail while maintaining a basic structure and performance of the injector.

In order to accomplish the above object, the present invention provides an injector fixing structure of a fuel rail, which may be used in a fuel rail module and be configured such that an injector cup that includes a slot formed at a side thereof and an injector that includes an anti-rotation pin inserted into the slot may be coupled to each other by a clip. The injector fixing structure may include a lock formed integrally with the anti-rotation pin, and a fixing member coupled to the slot and allowing the lock to be secured when the anti-rotation pin is inserted into the slot such that the anti-rotation pin may be prevented from being separated from the slot.

Further, the fixing member may be disposed at a lower end portion of the slot of the injector cup such that after the anti-rotation pin is inserted through a space between the slot and the fixing member, the lock may be secured to an upper end portion of the fixing member. Additionally, the anti-rotation pin may be divided into first to third pin members.

Meanwhile, the lock may be formed on a front surface of the second pin member that is a middle pin member of the first to third pin members. The second pin member may be elastically deformed in a rearward direction upon insertion into the slot such that the lock is allowed to pass through the fixing member, and be then restored to an original shape thereof after the lock has passed through the fixing member, whereby the lock is secured to the fixing member.

Alternatively, the lock may be formed on an outer side surface of each of the first and third pin members that are left and right oppositely disposed pin members of the first to third pin members. Further, the slot may include stepped portions disposed at a lower end portion of the slot by protruding from each of opposite inside surfaces of the slot such that the locks are secured to the stepped portions. The first and third pin members may be elastically deformed in left and right directions upon insertion into the slot such that the locks are allowed to pass through the stepped portions of the slot, and be then restored to original shapes thereof after the locks have passed through the stepped portions, whereby the locks are secured to the stepped portions.

In addition, the lock may be formed on a rear surface of the second pin member that is a middle pin member of the first to third pin members. Further, the slot may include a stepped portion disposed at a lower end portion of the slot by protruding in a forward direction such that the lock is secured to the stepped portion. The second pin member may be elastically deformed in the forward direction upon insertion into the slot such that the lock is allowed to pass through the stepped portion of the slot, and be then restored to an original shape thereof after the lock has passed through the stepped portion, whereby the lock is secured to the stepped portion.

The present invention may prevent separation of the injector from the fuel rail during transportation of the fuel rail module, thereby improving assemblability of the fuel rail module in engine assembly and increasing process efficiency.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

The present invention will be described in detail below with reference to the accompanying drawings.

Figure 1:
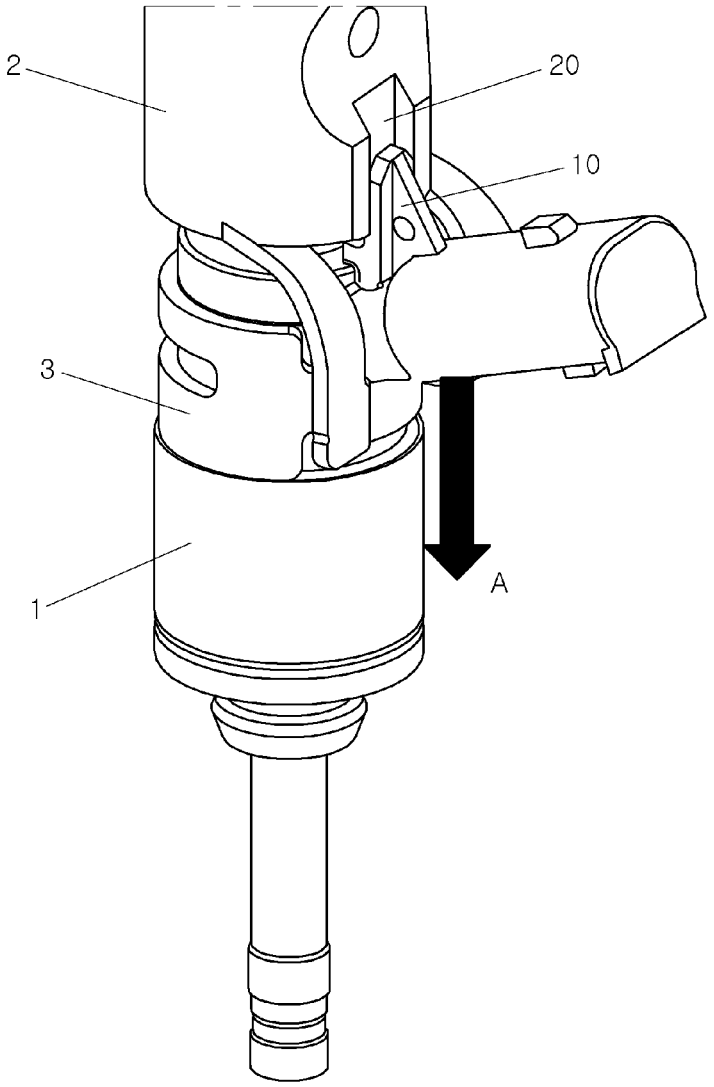
FIG. 1 shows an injector fixing structure of a fuel rail of a fuel rail module according to the related art.
Figure 2:
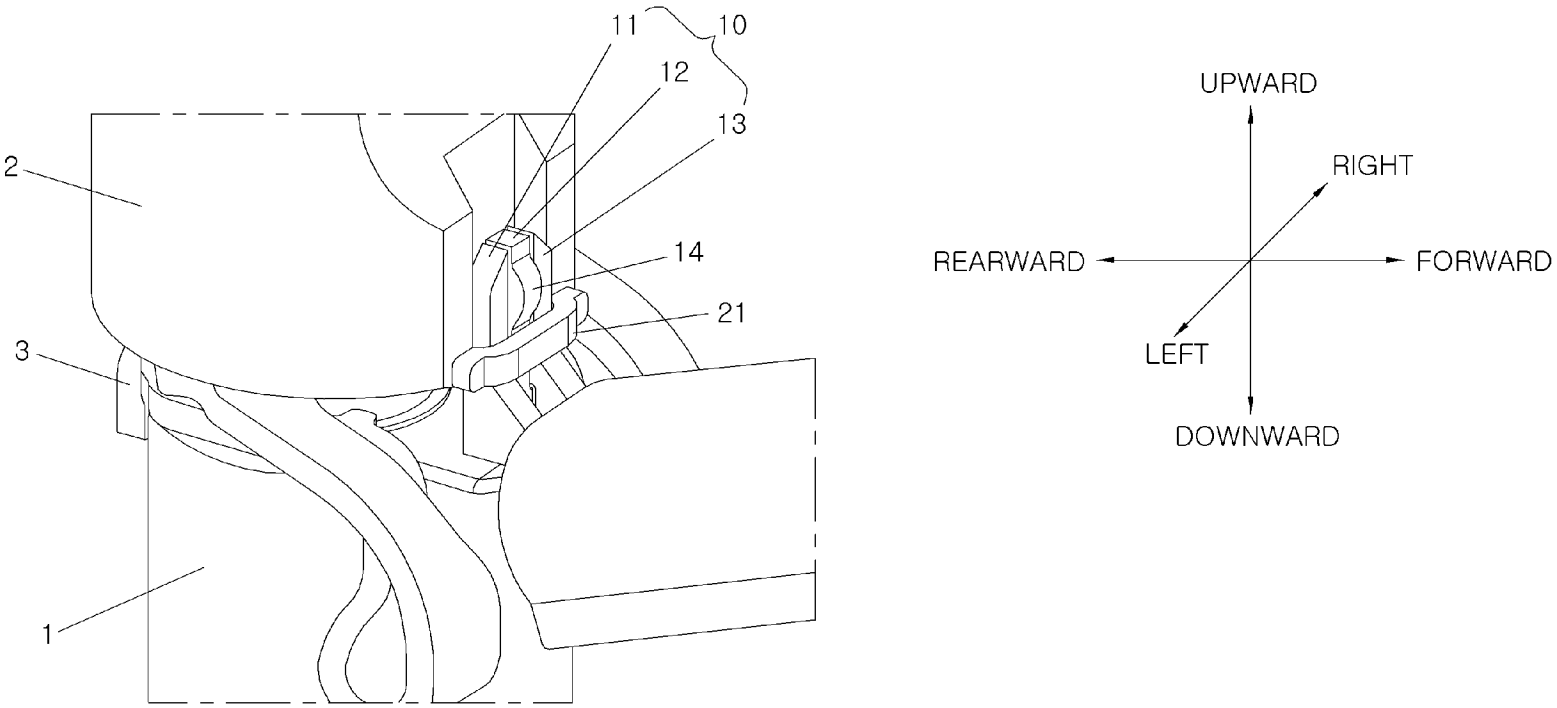
FIG. 2 shows an injector fixing structure of a fuel rail of a fuel rail module according to a first exemplary embodiment of the present invention.

Referring to FIG. 2, an injector fixing structure of a fuel rail according to a first exemplary embodiment of the present invention may include a lock 14 and a fixing member 21. The lock 14 may be formed integrally with an anti-rotation pin 10 of an injector 1, and the anti-rotation pin 10 of the injector 1 according to the exemplary embodiment of the present invention may be divided into first to third pin members 11, 12, and 13. The lock 14 may be formed on a front surface of the second pin member 12 that is a middle pin member of the respective pin members.

The fixing member 21 may be coupled to a slot 20 of the injector cup 2 such that a space where the anti-rotation pin 10 of the injector 1 is inserted may be defined between the slot 20 and the fixing member 21. The fixing member 21 may be coupled to a lower end portion of the slot 20 of the injector cup 2 such that the anti-rotation pin 10 may be inserted between the slot 20 and the fixing member 21 and then the lock 14 may be secured to an upper end portion of the fixing member 21. Since the anti-rotation pin 10 may be divided into the first to third pin members 11, 12, and 13, each pin member may be elastically deformed in forward, rearward, left, and right directions. Accordingly, the second pin member 12 that includes the lock 14 formed thereon may be elastically deformed in the rearward direction upon insertion into the slot 20 such that the lock 14 may be allowed to pass through the fixing member 21, and then be restored to an original shape thereof after the lock 14 has passed through the fixing member 21, whereby the lock 14 may be secured to the fixing member 21.

According to the injector fixing structure of the fuel rail according to the first exemplary embodiment of the present invention having the above configuration, when the anti-rotation pin 10 of the injector 1 is inserted into the slot 20 of the injector cup 2, the anti-rotation pin 10 may be supported and retained by the slot 20 and the fixing member 21 to prevent the injector 1 from being separated in the forward and rearward directions, while the first and third pin members 11 and 13 of the anti-rotation pin 10 may be supported and retained on left and right opposed inside surfaces of the slot 20, respectively, to prevent the injector 1 from rotating in the left and right directions. Furthermore, the lock 14 of the second pin member 12 may be secured to the fixing member 21 supportably and retainably to prevent the injector 1 from being separated in upward and downward directions. Consequently, secure and reliable coupling of the injector 1 may be maintained during transportation of a fuel rail module.

Figure 3:
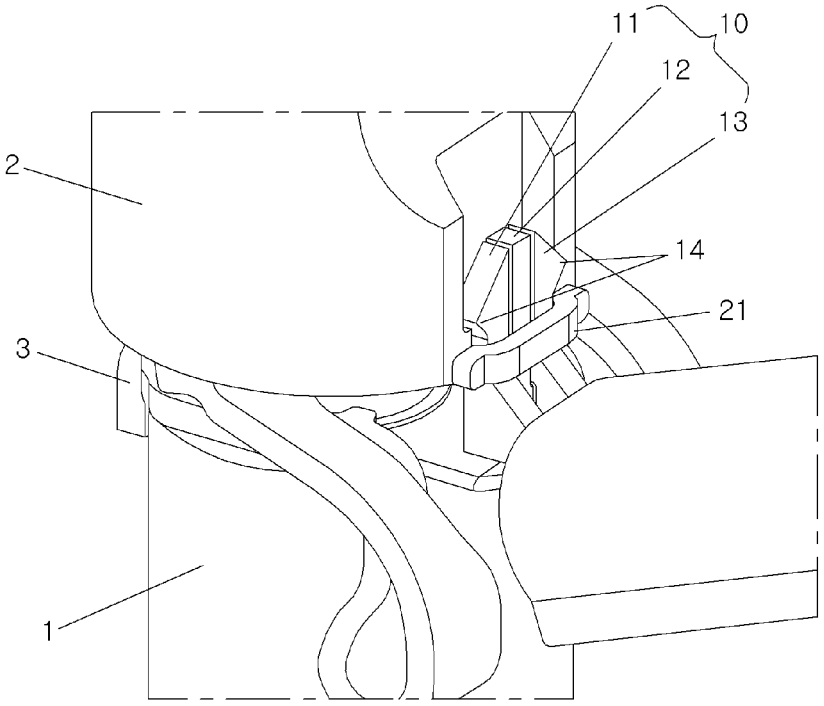
FIGS. 3 and 4 show an injector fixing structure of a fuel rail of a fuel rail module according to a second exemplary embodiment of the present invention.
Figure 4:
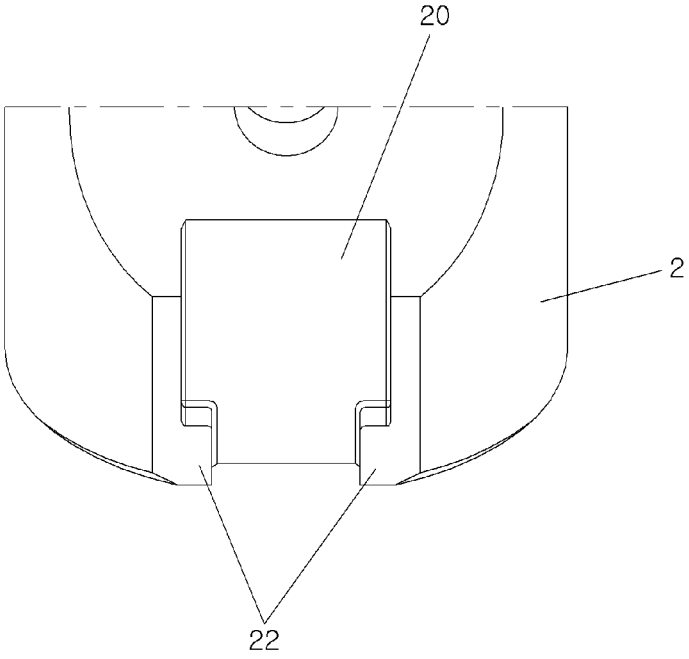

FIGS. 3 and 4 are views showing an injector fixing structure of a fuel rail according to a second exemplary embodiment of the present invention. The injector fixing structure of the fuel rail according to the second exemplary embodiment may be configured such that a lock 14 is formed on an outer side surface of each of first and third pin members 11 and 13 of an anti-rotation pin 10, and a stepped portion 22 is formed at a lower end portion of a slot 20 by protruding from each of left and right opposed inside surfaces thereof such that the locks 14 may be secured to the stepped portions 22.

The first and third pin members 11 and 13 that include the locks 14 formed thereon may be elastically deformed in the left and right directions upon insertion into the slot 20 such that the locks 14 may be allowed to pass through the stepped portions 22 of the slot 20, and then be restored to original shapes thereof after the locks 14 have passed through the stepped portions 22, whereby the locks 14 may be secured to the stepped portions 22 of the slot 20.

According to the injector fixing structure of the fuel rail according to the second exemplary embodiment of the present invention having the above configuration, when the anti-rotation pin 10 of the injector 1 is inserted into the slot 20 of the injector cup 2, the anti-rotation pin 10 may be supported and retained by the slots 20 and the fixing member 21 to prevent the injector 1 from being separated in the forward and rearward directions, while the first and third pin members 11 and 13 of the anti-rotation pin 10 may be supported and retained on the left and right opposed inside surfaces of the slot 20, respectively, to prevent the injector 1 from rotating in the left and right directions. Furthermore, the locks 14 of the first and third pin members 11 and 13 may be respectively secured to the stepped portions 22 of the slot 20 supportably and retainably to prevent the injector 1 from being separated in the upward and downward directions. Consequently, secure and reliable coupling of the injector 1 may be maintained during transportation of a fuel rail module.

Figure 5:
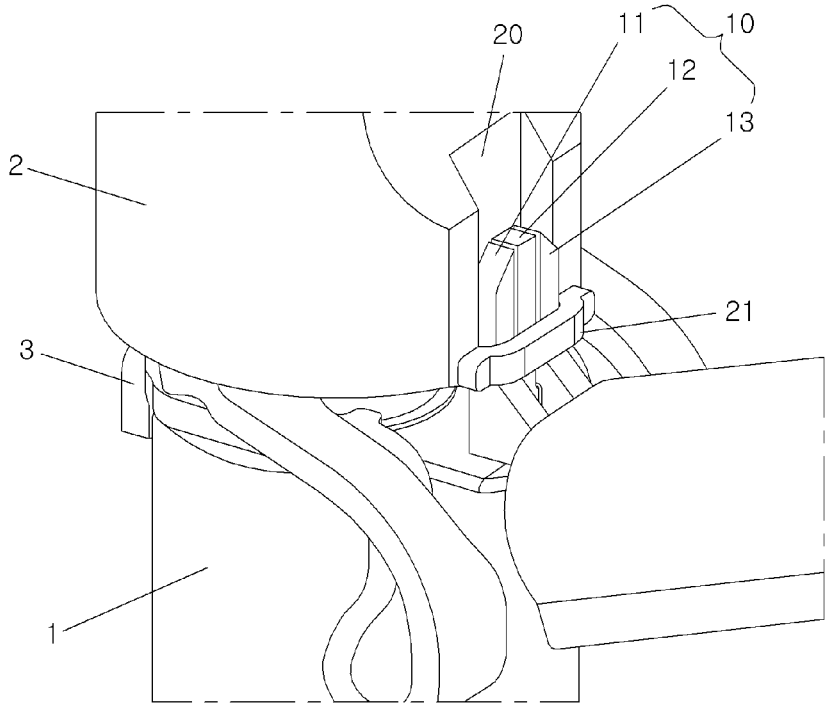
FIGS. 5 and 6 show an injector fixing structure of a fuel rail of a fuel rail module according to a third exemplary embodiment of the present invention.
Figure 6:
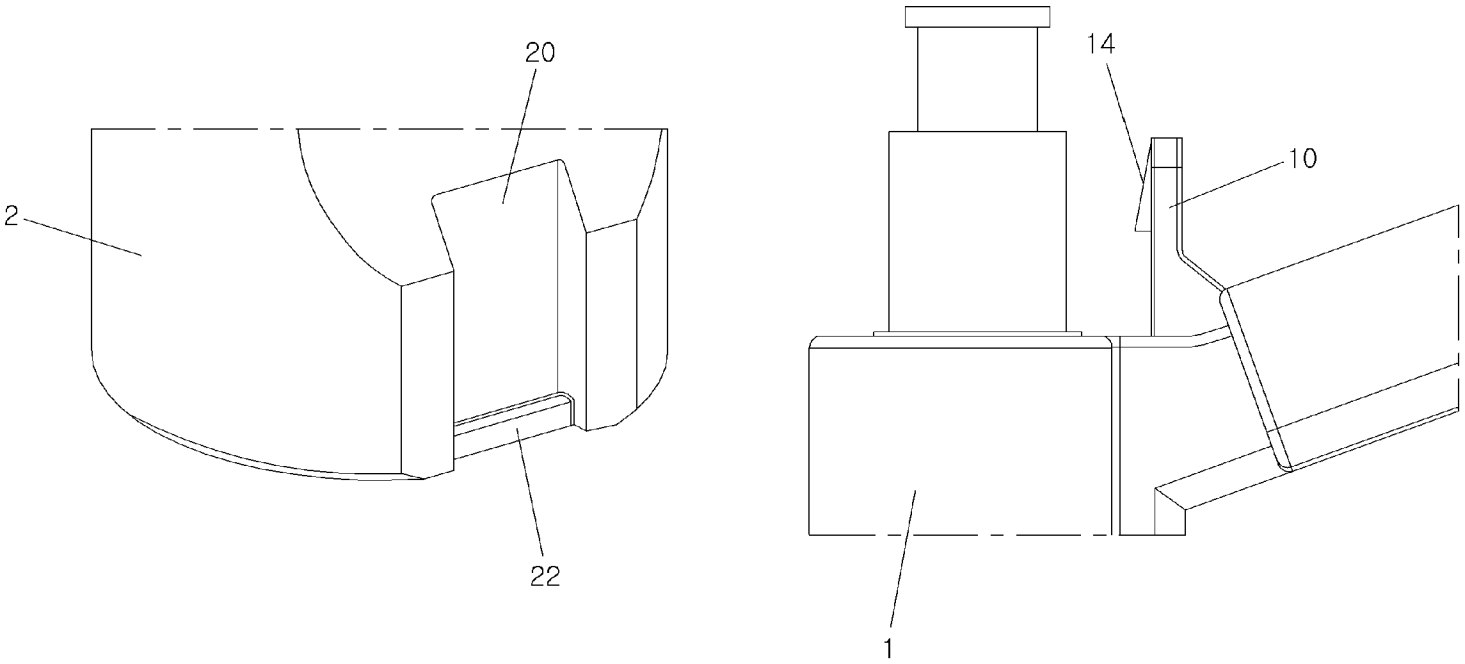

FIGS. 5 and 6 are views showing an injector fixing structure of a fuel rail according to a third exemplary embodiment of the present invention. The injector fixing structure of the fuel rail according to the third exemplary embodiment of the present invention may be configured such that a lock 14 is formed on a rear surface of a second pin member 12 of an anti-rotation pin 10, and a stepped portion 22 is formed at a lower end portion of a slot 20 by protruding in the forward direction such that the lock 14 may be secured to the stepped portion 22.

The second pin member 12 having the lock 14 formed thereon may be elastically deformed in the forward direction upon insertion into the slot 20 such that the lock 14 may be allowed to pass through the stepped portion 22 of the slot 20, and then be restored to an original shape thereof after the lock 14 has passed through the stepped portion 22, whereby the lock 14 may be secured to the stepped portion 22 of the slot 20.

According to the injector fixing structure of the fuel rail according to the third exemplary embodiment of the present invention having the above configuration, when the anti-rotation pin 10 of the injector 1 is inserted into the slot 20 of the injector cup 2, the anti-rotation pin 10 may be supported and retained by the slot 20 and the fixing member 21 to prevent the injector 1 from being separated in the forward and rearward directions, while the first and third pin members 11 and 13 of the anti-rotation pin 10 may be supported and retained on the left and right opposed inside surfaces of the slot 20, respectively, to prevent the injector 1 from rotating in the left and right directions. Furthermore, the lock 14 of the second pin member 12 may be secured to the stepped portion 22 of the slot 20 supportably and retainably to prevent the injector 1 from being separated in the upward and downward directions. Consequently, secure and reliable coupling of the injector 1 may be maintained during transportation of a fuel rail module.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The present invention is intended to cover not only the exemplary embodiments, but also various alternatives, modifications, equivalents and other embodiments that may be included within the spirit and scope of the present invention as defined by the appended claims. In addition, the scope of the present invention is defined by the accompanying claims rather than the description which is presented above.

What is claimed is:

1. An injector fixing structure of a fuel rail for a fuel rail module wherein an injector cup that includes a slot formed at a side thereof and an injector that includes an anti-rotation pin inserted into the slot are coupled to each other by a clip, the injector fixing structure comprising:

a lock formed integrally with the anti-rotation pin; and a fixing member coupled to the slot and allowing the lock to be secured when the anti-rotation pin is inserted into the slot such that the anti-rotation pin is prevented from being separated from the slot, wherein the anti-rotation pin is divided into first to third pin members which are separated from each other such that each pin member is configured to be elastically deformed in forward, rearward, left, and right direction, and wherein the lock is formed on a surface of the second pin member that is a middle pin member of the first to third pin members.

2. The injector fixing structure of claim 1, wherein the fixing member is provided at a lower end portion of the slot of the injector cup such that after the anti-rotation pin is inserted through a space between the slot and the fixing member, the lock is secured to an upper end portion of the fixing member.

3. The injector fixing structure of claim 1, wherein the lock is formed on a front surface of the second pin member.

4. The injector fixing structure of claim 3, wherein the second pin member is elastically deformed in a rearward direction upon insertion into the slot such that the lock is allowed to pass through the fixing member, and is then restored to an original shape thereof after the lock passes through the fixing member, whereby the lock is secured to the fixing member.

* * * * *